US010907319B2

(12) United States Patent
Milano et al.

(10) Patent No.: US 10,907,319 B2
(45) Date of Patent: Feb. 2, 2021

(54) BLINDSIDE WATERPROOFED BUILDING FOUNDATION SYSTEM AND METHOD OF FORMING SAME

(71) Applicant: TREMCO INCORPORATED, Beachwood, OH (US)

(72) Inventors: Steven Milano, Aurora, OH (US); Pamela Hernandez, Medina, OH (US); Louis Ferri, Solon, OH (US); Mason Averill, Streetsboro, OH (US)

(73) Assignee: TREMCO INCORPORATED, Beachwood, OH (US)

( * ) Notice: Subject to any disclaimer, the term of this patent is extended or adjusted under 35 U.S.C. 154(b) by 0 days.

(21) Appl. No.: 16/722,312

(22) Filed: Dec. 20, 2019

(65) Prior Publication Data

US 2020/0199840 A1 Jun. 25, 2020

Related U.S. Application Data

(60) Provisional application No. 62/783,435, filed on Dec. 21, 2018.

(51) Int. Cl.
*E02D 27/10* (2006.01)
*E02D 27/30* (2006.01)
*E02D 31/02* (2006.01)

(52) U.S. Cl.
CPC ..... *E02D 27/10* (2013.01); *E02D 27/30* (2013.01); *E02D 31/02* (2013.01);
(Continued)

(58) Field of Classification Search
CPC ..... E04B 1/66; E02D 31/00; E02D 27/30; E02D 31/02; E02D 2250/00;
(Continued)

(56) References Cited

U.S. PATENT DOCUMENTS 3,243,963 A 4/1966 Schnabel, Jr.
4,065,924 A 1/1978 Young
(Continued)

FOREIGN PATENT DOCUMENTS

CA 1202190 A 3/1986
EP 2177349 A1 4/2010
(Continued)

OTHER PUBLICATIONS

Selander, Anders et al.,"Hydrophobic shotcrete-a method to waterproof tunnels"; Hydrophobe VII 7th International Conference on Water Repellant Treatment and Protective Surface Technology for Building Materials; Lisbon; 2014; pp. 67-75; http://hydrophobe.org/pdf/lisboa/VII_07.pdf.
(Continued)

*Primary Examiner* — Carib A Oquendo
(74) *Attorney, Agent, or Firm* — Calfee, Halter & Griswold LLP

(57) ABSTRACT

A blindside waterproofed building foundation system and method of forming the same are provided. The system includes a lagging wall, a monolithic waterproof layer adjacent to the lagging wall, and a foundation layer adjacent to the monolithic waterproof layer. The system and method provide a monolithic waterproofing layer that can remain adhered to a foundation surface even if the materials used to construct the lagging wall deteriorates, decomposes, or moves over time.

20 Claims, 2 Drawing Sheets

(52) U.S. Cl.
CPC .. *E02D 2250/00* (2013.01); *E02D 2300/0001* (2013.01); *E02D 2300/0006* (2013.01); *E02D 2300/0007* (2013.01); *E02D 2300/0014* (2013.01); *E02D 2300/0051* (2013.01); *E02D 2300/0053* (2013.01); *E02D 2300/0054* (2013.01); *E02D 2300/0064* (2013.01); *E02D 2300/0079* (2013.01)

(58) Field of Classification Search
CPC .... E02D 2300/0001; E02D 2300/0006; E02D 2300/0007; E02D 2300/0014; E02D 2300/0051; E02D 2300/0053; E02D 2300/0054; E02D 2300/0064; E02D 2300/0079
See application file for complete search history.

(56) References Cited

U.S. PATENT DOCUMENTS

| | | | |
|---|---|---|---|
| 4,561,804 | A | 12/1985 | Weatherby |
| 5,002,438 | A | 3/1991 | Strong |
| 5,389,166 | A | 2/1995 | White |
| 5,496,615 | A | 3/1996 | Bartlett |
| 5,671,889 | A | 9/1997 | Petty |
| 5,891,224 | A | 4/1999 | Aoyama et al. |
| 5,897,061 | A | 4/1999 | Petty |
| 6,193,439 | B1 | 2/2001 | Wolfseher |
| 6,225,393 | B1 | 5/2001 | Woods |
| 6,399,687 | B2 | 6/2002 | Woods |
| 6,489,032 | B1 | 12/2002 | Discho et al. |
| 6,648,962 | B2 | 11/2003 | Berke et al. |
| 6,761,504 | B1 | 7/2004 | Brandenberger et al. |
| 6,767,164 | B2 | 7/2004 | Shimizu et al. |
| 6,793,441 | B2 | 9/2004 | Shimizu et al. |
| 6,852,813 | B2 | 2/2005 | Darlington, Jr. et al. |
| 7,290,960 | B2 | 11/2007 | Sengupta et al. |
| 7,565,779 | B2 | 7/2009 | Iske et al. |
| 7,662,221 | B2 | 2/2010 | Fay |
| 7,722,293 | B2 | 5/2010 | Kruse |
| 8,291,668 | B2 | 10/2012 | Iske et al. |
| 8,322,949 | B2 | 12/2012 | Kruse |
| 8,454,773 | B2 | 6/2013 | Cisneros |
| 8,524,822 | B2 | 9/2013 | Wiercinski |
| 8,635,833 | B2 | 1/2014 | Anderson |
| 8,765,841 | B2 | 7/2014 | Brien |
| 9,428,879 | B2 | 8/2016 | Gancel et al. |
| 9,605,423 | B2 | 3/2017 | Cogburn |
| 9,909,313 | B1 | 3/2018 | Grubbs |
| 9,951,519 | B2 | 4/2018 | Neil |
| 10,017,910 | B2 | 7/2018 | Kruse |
| 10,227,749 | B2 | 3/2019 | Ames et al. |
| 2008/0178769 | A1 | 7/2008 | Goodwin et al. |
| 2011/0203218 | A1 | 8/2011 | Solov et al. |
| 2012/0198787 | A1 | 8/2012 | Mo et al. |
| 2013/0302557 | A1 | 11/2013 | Cisneros |
| 2014/0144091 | A1 | 5/2014 | Neil |
| 2015/0197909 | A1 | 7/2015 | Huh |
| 2016/0097278 | A1 | 4/2016 | Huh |
| 2018/0313055 | A1 | 11/2018 | Ames et al. |

FOREIGN PATENT DOCUMENTS

| | | | |
|---|---|---|---|
| EP | 2907832 | A1 | 8/2015 |
| KR | 101881577 | B1 | 8/2018 |
| WO | 9738174 | A1 | 10/1997 |

OTHER PUBLICATIONS

Shin, H-S et al., "Effect of the patternised pin drain on reduction of pore pressure behind waterproof shotcrete linings for tunneling"; 13th Australian Tunnelling Conference 2008; https://search.informit.com.au/documentSummary;dn=. . . .

Jumaat, M.Z. et al., "A Review of the Repair of Reinforced Concrete Beams"; Journal of Applied Science Research, 2(6): 317-326, 2006: http://eprints.um.edu.my/6103/.

ASTM International, Designation: C794-10, "Standard Test Method for Adhesion-in-Peel of Elastomeric Joint Sealants," Oct. 2010.

International Search Report and Written Opinion for International Application No. PCT/US2019/067776 dated May 11, 2020.

BLINDSIDE WATERPROOFED BUILDING FOUNDATION SYSTEM AND METHOD OF FORMING SAME

CROSS-REFERENCE TO RELATED APPLICATIONS

This application claims priority to and the benefit of U.S. Provisional Patent Application No. 62/783,435, filed Dec. 21, 2018, the entire content of which is incorporated by reference herein.

FIELD

The general inventive concepts relate to building foundations and, more particularly, to a blindside waterproofed building foundation system and method of forming the same.

BACKGROUND

Blindside waterproofing is considerably more complex than traditional below-grade waterproofing because the construction process is reversed, and waterproofing is installed before the foundation is poured or applied. Structures are increasingly being built on less desirable or hard to access land. Typically, blindside waterproofing projects are required in high-density areas where property lines, nearby structures, and terrain limit excavation, access, and otherwise result in congested areas.

Conventional blindside waterproofing systems and methods typically utilize multiple sheets of waterproofing membrane material that are adhered or fastened to a lagging wall. Because conventional blindside waterproofing systems and methods use multiple sheets of waterproofing membrane material, each joint, seam, or lap between adjacent membranes or other openings (e.g., openings to accommodate tieback anchors) must also be sealed to ensure complete waterproofing. Such conventional systems and methods are highly labor intensive and tedious, which increases the overall time and costs associated with constructing a waterproofed foundation in this manner.

Another problem associated with conventional blindside waterproofing systems involves the deterioration over time of the lagging wall, which typically includes wooden planks or timbers. Intimate contact with soil and moisture may cause the wooden planks or timbers to deteriorate or decompose, or the lagging wall may move or shift, and the waterproofing membrane material may remain adhered or fastened to the wooden planks or timbers instead of the foundation, which could expose the foundation surface to soil and moisture.

Accordingly, there remains a need in the art for a blindside waterproofed building foundation system and method that address the problems associated with conventional blindside waterproofing systems and methods.

SUMMARY

The general inventive concepts relate to a blindside waterproofed building foundation system and method of forming the same. To illustrate various aspects of the general inventive concepts, several exemplary embodiments of the system and method are disclosed.

In accordance with the present disclosure, a blindside waterproofed building foundation system is provided. The system includes a lagging wall, a monolithic waterproof layer adjacent to the lagging wall, and a foundation layer adjacent to the monolithic waterproof layer.

In accordance with the present disclosure, a method of forming a blindside waterproofed building foundation is provided. The method includes forming a lagging wall, applying a monolithic waterproof layer onto the lagging wall, and applying a foundation layer onto the monolithic waterproof layer.

Other aspects, advantages, and features of the general inventive concepts will become apparent to those skilled in the art from the following detailed description, when read in light of the accompanying drawings.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Figure 1:
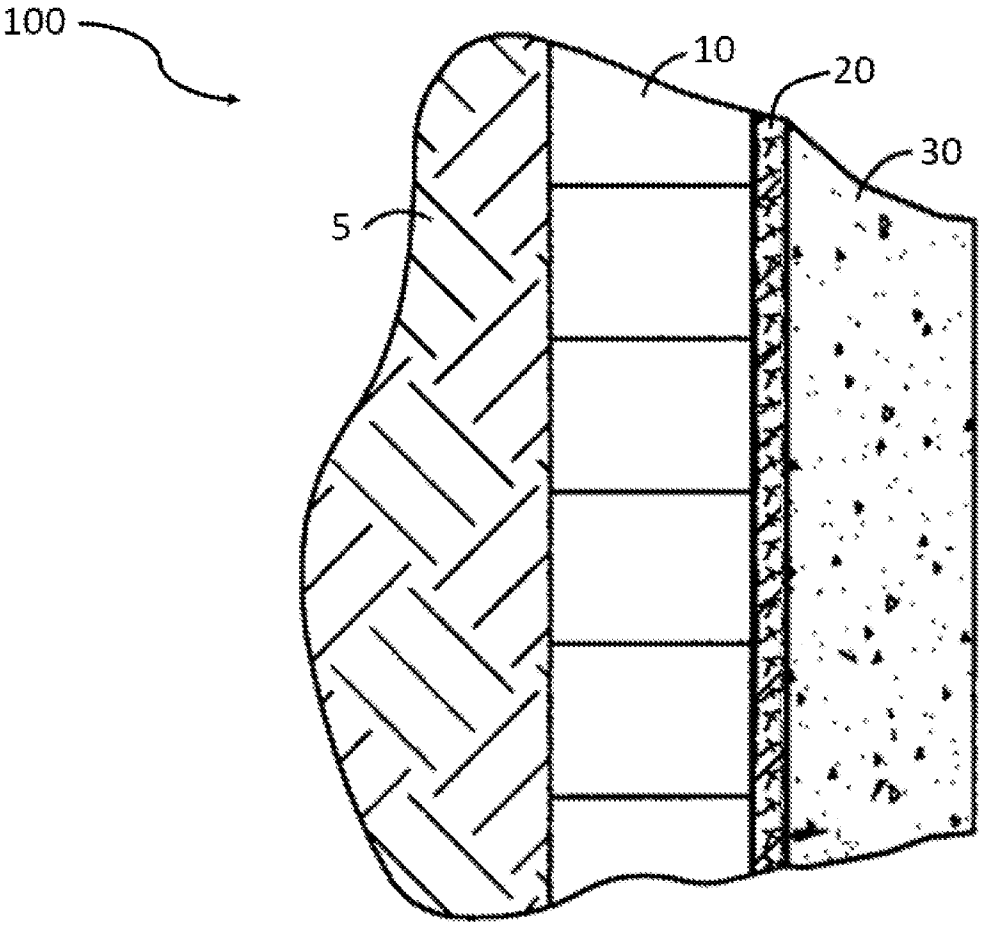
FIG. 1 is a cross-sectional elevation view, partially broken away, showing an embodiment of a blindside waterproofed building foundation system of the present disclosure.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

The present application discloses exemplary embodiments of a blindside waterproofed building foundation system and methods of forming blindside waterproofed building foundations. The inventive system and method is much less labor intensive than conventional blindside waterproofing systems and methods, which reduces the overall time and costs associated with forming a blindside waterproofed building foundation. Moreover, the inventive system and method provides a monolithic waterproof layer that remains adhered to a foundation surface even if the materials used to form a lagging wall deteriorate or decompose over time, or if the lagging wall moves or shifts due to reasons such as soil erosion, seismic shifts, or building settling.

The term "monolithic" as used herein refers to a unitary structure that does not have any joints, seams, or laps.

Referring now to FIG. 1, an embodiment of a blindside waterproofed building foundation system 100 according to the present disclosure is shown. The system 100 includes a lagging wall 10, a monolithic waterproof layer 20 adjacent to the lagging wall 10, and a foundation layer 30 adjacent to the monolithic waterproof layer 20.

Figure 2:
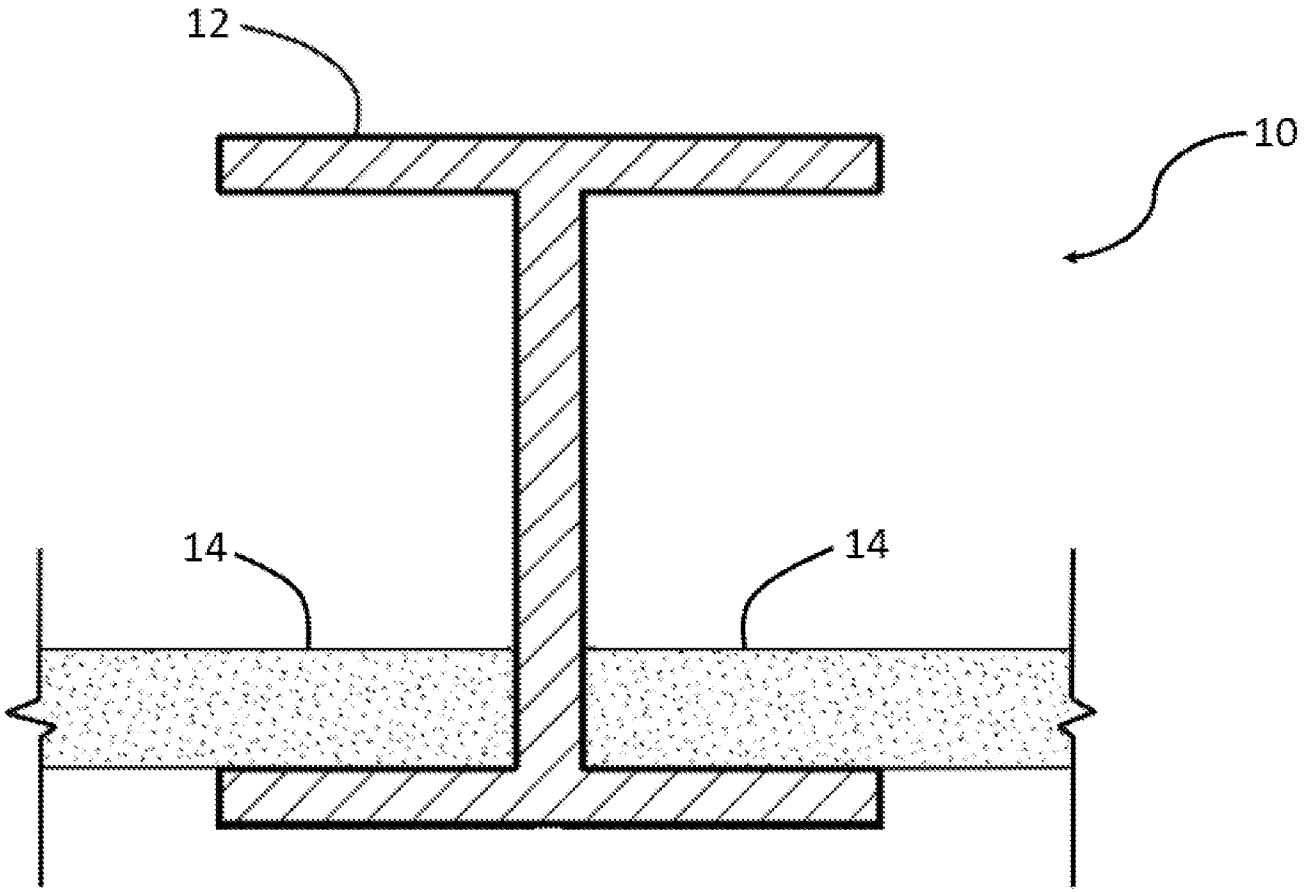
FIG. 2 is a top plan view illustrating an embodiment of a lagging wall of a blindside waterproofed building foundation system of the present disclosure.

As seen in FIG. 1, the lagging wall 10 is installed vertically next to soil 5. The lagging wall 10 generally includes a plurality of piles and a plurality of lagging planks placed between and spanning adjacent piles. Generally, there are gaps between the lagging planks of the lagging wall 10, which gaps may be 1/64 inch to 2 inches, but more typically are 0.25 inch to 0.75 inch. FIG. 2 illustrates a typical lagging wall 10 arrangement that includes a pile 12 (only one pile is shown) and lagging planks 14 that abut a flange of the pile 12. As seen in FIG. 2, the piles 12 may have an "I-beam" or "H-beam" configuration. The piles 12 may be formed of steel or concrete (pre-cast or cast-in-place), or other structural materials known in the art. Steel piles or pre-cast concrete piles can either be installed in pre-drilled pilot holes in an excavation site and backfilled with concrete or can be installed by driving the piles directly into an excavation site. Cast-in-place concrete piles can be constructed in pre-drilled holes in an excavation site. It should be understood that any conventional pile may be used in accordance with the present disclosure to form the lagging wall 10.

With continued reference to FIG. 2, a plurality of lagging planks 14 are placed horizontally between and span adjacent piles 12 to form the lagging wall 10. The lagging planks 14 may be formed from a variety of materials. Exemplary materials include, but are not limited to, wood or timber, polymeric lumber, concrete, and steel. Preferably, the lagging planks 14 are formed of wood or timber. As seen in FIG. 2, the lagging planks 14 may be placed within the flanges of the pile 12 and span horizontally to the next adjacent pile 12. Alternatively, the lagging planks 14 may be secured to the pile 12 in front of the flanges or secured to the pile 12 behind the flanges and span horizontally to the next adjacent pile 12. As mentioned above, there are typically gaps between the lagging planks, which gaps may be 1/64 inch to 2 inches, but more typically are 0.25 inch to 0.75 inch. Although these gaps are conventional in lagging walls, such gaps permit ingress of water. The placement of lagging planks 14 may continue until a desired height of the lagging wall 10 is achieved. In certain embodiments, the lagging wall 10 may also include tieback anchors (not shown) to provide lateral support.

Referring again to FIG. 1, the blindside waterproofed building foundation system 100 according to the present disclosure includes a monolithic waterproof layer 20 adjacent to the lagging wall 10. In accordance with the present disclosure, the monolithic waterproof layer 20 is a unitary structure that has no joints, no seams, and no laps. In general, the monolithic waterproof layer 20 includes a matrix material and a filler material. A variety of materials may be used as a matrix material to form the monolithic waterproof layer 20. Exemplary matrix materials suitable for use in forming the monolithic waterproof layer 20 of the present disclosure include, but are not limited to, polyolefins (e.g., polyethylene, polypropylene), polyvinyl chloride (PVC), polyvinylidene chloride, polyesters, polystyrenes, polyamides, ethylene vinyl acetate (EVA), polyurethanes, polyureas, polyepoxides, silicone, silicone hybrids, fluoropolymers, polyacrylonitriles, rubber materials, polyacrylics, asphaltic materials, latexes, and the like. In embodiments of the present disclosure, the matrix material may comprise mixtures, blends, interpenetrating polymer networks, and/or copolymers of the aforementioned matrix materials. In embodiments of the present disclosure, the matrix material may be a hot-applied material. The matrix material may also include additives such as plasticizers, colorants, stabilizers, coupling agents, and the like. Such additives may also include chemicals that promote chemical bonding with the cementitious material of the foundation layer 30 via techniques including, but not limited to, acid-base interactions, covalent bonding, and ionic bonding. The additives may comprise up to about 90% by weight of the matrix material, including from 0.1% to 90% by weight, from 0.1% to 75% by weight, from 0.1% to 50% by weight, from 0.1% to 25% by weight, from 0.1% to 10% by weight, from 0.1% to 5% by weight, and also including from 0.1% to 3% by weight of the matrix material. The monolithic waterproof layer 20 may block the passage of both liquid water and water vapor or a brownfield gas (e.g., methane, radon) and, thus, may also serve as a vapor barrier, vapor retarder, and/or gas barrier.

As mentioned above, the monolithic waterproof layer 20 of the present disclosure also includes a filler material. Any filler material known in the art that is capable of imparting a texturized surface may be used in accordance with the present disclosure. By imparting a texturized surface, the filler material may improve the adherence of the foundation layer 30 to the monolithic waterproof layer 20. A variety of materials may be used as the filler material to form the monolithic waterproof layer 20. The filler material may have various shapes or forms including, but not limited to, fibers, flakes, beads, and the like. Exemplary filler materials suitable for use in forming the monolithic waterproof layer 20 of the present disclosure include, but are not limited to, glass fibers, polymer fibers, carbon fibers, ceramic fibers, metal fibers, natural fibers (e.g., jute, hemp, cotton), glass flakes, corn-cob shell, walnut shell, sand, silica, calcium carbonate particles, limestone particles, limestone fines, ground reprocessed concrete, ground rubber, polymeric particles, Portland cement, pozzolanic materials, expanded glass spheres, and the like. In embodiments of the present disclosure, the filler material comprises chopped glass fibers. In embodiments of the present disclosure, the glass fibers comprise alkali resistant chopped glass fibers. In addition to the ability to impart a texturized surface that can improve adherence of the foundation layer 30, the filler material of the monolithic waterproof layer 20 is also capable of bridging the gaps between the lagging planks of the lagging wall 10. By way of example only, the filler material may comprise alkali resistant chopped glass fibers having a minimum length of 0.125 inch, which when combined with the matrix material is capable of bridging gaps between lagging planks that range from 0.25 inch to 2 inches. By bridging the gaps between the lagging planks, the filler material essentially provides structure onto which the matrix material can adhere so as to bridge or close the gaps between the lagging planks to provide an effective barrier to water ingress. The monolithic waterproof layer 20 comprising the matrix material and the filler material is capable of withstanding compressive forces applied during application of the foundation layer 30. For example, the unsupported portions of the monolithic waterproof layer 20 (i.e., the portions located in the gaps between the lagging planks) are capable of withstanding the compressive forces (e.g., impingement forces) associated with the application of the foundation layer 30, which are typically 90 Newtons to 400 Newtons.

In embodiments of the present disclosure, the monolithic waterproof layer 20 comprises 5% to 95% by weight matrix material and from 5% to 95% by weight filler material. In embodiments of the present disclosure, the monolithic waterproof layer 20 comprises 10% to 90% by weight matrix material and from 10% to 90% by weight filler material. In embodiments of the present disclosure, the monolithic waterproof layer 20 comprises 20% to 80% by weight matrix material and from 20% to 80% by weight filler material. In embodiments of the present disclosure, the monolithic waterproof layer 20 comprises 30% to 70% by weight matrix material and from 30% to 70% by weight filler material. In embodiments of the present disclosure, the monolithic waterproof layer 20 comprises 40% to 70% by weight matrix material and from 30% to 60% by weight filler material. In embodiments of the present disclosure, the monolithic waterproof layer 20 comprises 50% to 65% by weight matrix material and from 35% to 50% by weight filler material. Any one or more of the previously mentioned matrix materials and filler materials may be used in the foregoing embodiments.

The monolithic waterproof layer 20 of the present disclosure may have a thickness of 0.060 inch to 6 inches. In embodiments of the present disclosure, the monolithic waterproof layer 20 may have a thickness of 0.25 inch to 4 inches. In embodiments of the present disclosure, the monolithic waterproof layer 20 may have a thickness of 0.5 inch to 3 inches. In embodiments of the present disclosure, the monolithic waterproof layer 20 may have a thickness of 0.75 inch to 2 inches.

In embodiments of the present disclosure, the monolithic waterproof layer 20 comprises a single matrix material and a single filler distributed throughout the matrix material. It is also contemplated that the monolithic waterproof layer 20 may comprise gradients of materials. The gradients of materials may comprise one or more of the previously described matrix materials, one or more of the previously described filler materials, or one or more of the previously described matrix materials in combination with one or more of the previously described filler materials.

In embodiments of the present disclosure, the monolithic waterproof layer 20 comprises a first gradient of material comprising a first matrix material and a first filler material, and a second gradient of material comprising a second matrix material and optionally a second filler material. The first matrix material and the second matrix material may be the same or different. Similarly, the first filler material and the optional second filler material may be the same or different. Any of the previously described matrix materials and filler materials may be used for the first and second matrix materials and the first and second filler materials. While the preceding describes the monolithic waterproof layer 20 comprising a first gradient of material and a second gradient of material, it is contemplated that the monolithic waterproof layer 20 may include additional gradient(s) of material (e.g., a third gradient of material, a fourth gradient of material, a fifth gradient of material, and so forth). The additional gradient(s) of material may comprise a matrix material that is the same or different from the first and/or second matrix materials. Similarly, the additional gradient(s) of material may optionally comprise a filler material that is the same or different from the first filler material and/or optional second filler material.

It is also contemplated that the gradients of material can transition to a final gradient of material that consists of one or more filler materials. In other words, in certain embodiments of the present disclosure, the final gradient of material includes only filler material and no matrix material. The filler material of the final gradient of material creates a texturized surface to promote better adherence of the foundation layer 30 to the monolithic waterproof layer 20. Any one or more of the previously described filler materials may be used in the final gradient of material.

In embodiments of the present disclosure, the first gradient of material comprises a polymer modified asphalt emulsion and chopped glass fibers, and the second gradient of material comprises a polymer modified asphalt emulsion. One example of a commercially available polymer modified asphalt emulsion is TREMproof® 260 asphalt emulsion from Tremco, Inc. (Beachwood, Ohio). In embodiments of the present disclosure, the first gradient of material comprises a styrene butadiene rubber (SBR) latex and chopped glass fibers, and the second gradient of material comprises a polymer modified asphalt emulsion.

In accordance with the present disclosure, and as seen in FIG. 1, the monolithic waterproof layer 20 is applied to the lagging wall 10. Preferably, the monolithic waterproof layer 20 is applied directly to the lagging wall 10 and bridges the gaps between the lagging planks of the lagging wall 20. In certain embodiments, it is contemplated that an optional intermediate layer of material, such as a drainage mat, may be applied directly to the lagging wall 10 and the monolithic waterproof layer 20 may be directly applied to the intermediate layer of material and, thus, indirectly applied to the lagging wall 10. The monolithic waterproof layer 20 may be applied to the lagging wall 10 in a variety of ways. In embodiments of the present disclosure, the monolithic waterproof layer 20 may be applied to the lagging wall 10 by techniques including, but not limited to, spraying, painting, brushing, rolling, and the like. In embodiments of the present disclosure, the monolithic waterproof layer 20 is applied to the lagging wall 10 by one or more of spraying, painting, brushing, and rolling. Preferably, the monolithic waterproof layer 20 is spray-applied onto the lagging wall 10. In embodiments of the present disclosure, at least a portion of the monolithic waterproof layer 20 may be spray-applied onto the lagging wall 10 using a resin spray chopper gun, such as the chopper guns used in spray-up molding for fiberglass applications.

In embodiments of the present disclosure, a first gradient of material comprising a first matrix material and a first filler material is spray-applied onto the lagging wall 10 and the second gradient of material comprising a second matrix material and optionally a second filler material is spray-applied onto the first gradient of material to form the monolithic waterproof layer 20. The first matrix material and the second matrix material may be the same or different. Similarly, the first filler material and the optional second filler material may be the same or different. Any of the previously described matrix materials and filler materials may be used for the first and second matrix materials and the first and second filler materials. It is contemplated that additional gradients of material may be used to form the monolithic waterproof layer 20. Furthermore, it is contemplated that each gradient of material may be applied using the same application technique or different application techniques. For example, the first gradient of material may be applied by spraying and the second gradient of material may be applied by rolling.

Spray application of the monolithic waterproof layer 20 onto the lagging wall 10 is much less labor intensive than conventional methods that require the application of multiple sheets of waterproofing membranes and ensuring that all joints, seams, and/or laps between adjacent membranes or other openings (e.g., openings to accommodate tieback anchors) are adequately sealed. Furthermore, spray application of the monolithic waterproof layer 20 onto the lagging wall 10 creates a monolithic waterproofing layer that is free from joints, seams, laps, and other openings, thus providing improved waterproofing capabilities over conventional blindside waterproofing techniques.

With reference again to FIG. 1, the blindside waterproofed building foundation system 100 according to the present disclosure includes a foundation layer 30 adjacent to the monolithic waterproof layer 20. In general, the foundation layer 30 comprises a cementitious material that is applied in a wet state and allowed to harden or cure over time. Any conventional cementitious material that is used in constructing building foundations may be used in accordance with the present disclosure.

In accordance with the present disclosure, the foundation layer 30 is applied to the monolithic waterproof layer 20. Preferably, the foundation layer 30 is applied directly to the monolithic waterproof layer 20. As previously noted, the monolithic waterproof layer 20 may have a texturized surface to increase the surface area onto which the foundation layer is applied 30. In addition, a texturized surface can promote better adherence of the foundation layer 30 to the monolithic waterproof layer 20 by providing projecting filler materials, uneven surfaces, and undercuts that bond or lock the foundation layer 30 to the monolithic waterproof layer 20. This bonding or locking is advantageous in that upon deterioration or decomposition of the lagging wall 10, the monolithic waterproof layer 20 remains adhered to the foundation layer 30 and waterproofing capabilities are not compromised.

In accordance with the present disclosure, the monolithic waterproof layer 20 preferentially adheres to the foundation layer 30 rather than to the lagging wall 10. This preferential adherence ensures that the monolithic waterproof layer 20 remains adhered to the foundation layer 30 to provide waterproofing capabilities upon deterioration, decomposition, and/or movement of the lagging wall 10. In embodiments of the present disclosure, an adhesive value between the monolithic waterproof layer 20 and the foundation layer 30 is greater than an adhesive value between the monolithic waterproof layer 20 and the lagging wall 10. The adhesive values can be determined using conventional peel tests known in the art, such as ASTM C794. In embodiments of the present disclosure, the monolithic waterproof layer 20 may adhere to the foundation layer 30 with an adhesive value that is greater than 5 pounds of force per linear inch, including from 5 pounds per linear inch to 100 pounds per linear inch, as determined by a conventional peel test such as ASTM C794. As such, the adhesive value between the monolithic waterproof layer 20 and the lagging wall 10 is less than 5 pounds per linear inch to less than 100 pounds per linear inch as long as the adhesive value between the waterproof layer 20 and the lagging wall 10 is less than the adhesive value between the monolithic waterproof layer 20 and the foundation layer 30.

In embodiments of the present disclosure, the foundation layer 30 may be reinforced with rebar or other suitable reinforcements. For example, a grid of rebar reinforcements may be installed adjacent to the monolithic waterproof layer 20, and the foundation layer 30 may be applied to the monolithic waterproof layer 20 and encase the grid of rebar reinforcements. The foundation layer 30 may be applied to the monolithic waterproof layer 20 in a variety of ways. In embodiments of the present disclosure, the foundation layer 30 may be applied to the monolithic waterproof layer 20 by techniques including, but not limited to, spraying, pouring, and the like. Preferably, the foundation layer 30 is spray-applied onto the monolithic waterproof layer 20. In embodiments of the present disclosure, the foundation layer 30 comprises shotcrete, which is a Portland cement material that is spray-applied onto the monolithic waterproof layer 20. In embodiments of the present disclosure, the foundation layer 30 comprises concrete that is poured-in-place. In embodiments of the present disclosure, the foundation layer 30 comprises a combination of shotcrete that is spray-applied and concrete that is poured-in-place.

The foundation layer 30 of the present disclosure may have a thickness that is appropriate in view of the structure to be erected. In embodiments of the present disclosure, the foundation layer 30 may have a thickness of 4 inches to 72 inches. In embodiments of the present disclosure, the foundation layer 30 may have a thickness of 12 inches to 60 inches.

The blindside waterproofed building foundation system and method of the present disclosure provides a number of advances over conventional blindside waterproofing systems and methods. For example, the blindside waterproofed building foundation system and method of the present disclosure ensures that the gaps between lagging planks in the lagging wall are bridged or closed to provide an effective barrier to water ingress. The blindside waterproofed building foundation system and method of the present disclosure also provides a monolithic waterproofing layer that does not include any joints, seams, laps, holes, or other openings that would potentially allow water ingress. In addition, the preferential adherence of the monolithic waterproof layer to the foundation layer rather than the lagging wall ensures that the monolithic waterproof layer remains adhered to the foundation layer to provide waterproofing capabilities upon deterioration or decomposition of the lagging wall.

EXAMPLES

The following examples further describe and demonstrate specific embodiments within the scope of the present disclosure. The examples are for purposes of illustration only and are not intended to limit the scope of the present disclosure.

Example 1

In this example, qualitative tests were conducted to evaluate the adhesive values of several matrix materials (with and without a filler) to a wood material and to a simulated shotcrete material. The qualitative testing was conducted as follows. Approximately 60 mils (about 1.5 mm) of matrix material (with or without a filler) was applied to a 12 inch by 12 inch piece of oriented strand board (OSB) and allowed to cure. Next, a wet mix of Eucoshot 105 50 shotcrete (available from Euclid Chemical Co., Cleveland, Ohio) was applied to the cured matrix material and compressed with 2 psi of force to simulate real world shotcrete impingement forces. After the shotcrete cured, the resulting assembly was subjected to an impact force using a hammer. The resulting adhesion between each layer was observed and rated on a scale of 1-10. The results of the qualitative testing is shown in Table 1, and a description of the qualitative adhesion values is shown in Table 2.

TABLE 1

Qualitative Testing Results

| Sample No. | Matrix Material | Adhesion to Wood | Adhesion to Shotcrete |
|---|---|---|---|
| Sample 1 | A commercially available polymer modified asphalt emulsion sealant* (TREMproof ® 260, available from Tremco, Inc., Beachwood, Ohio) | 8 | 8 |
| Sample 2 | The commercially available Polymer modified asphalt emulsion sealant of Sample 1 with 5% by weight ¼" chopped glass fibers | 6 | 8 |
| Sample 3 | A commercially available polyurethane methacrylate based sealant (Vulkem ® EWS, available from Tremco, Inc., Beachwood, Ohio) | 4 | 6 |

TABLE 1-continued

| Qualitative Testing Results | | | |
|---|---|---|---|
| Sample No. | Matrix Material | Adhesion to Wood | Adhesion to Shotcrete |
| Sample 4 | The commercially available polyurethane methacrylate based sealant of Sample 3 with 5% by weight ¼" chopped glass fibers | 4 | 8 |
| Sample 5 | A commercially available polyurea based sealant, available from Euclid Chemical Co., Cleveland, Ohio | 4 | 2 |
| Sample 6 | The commercially available polyurea based sealant of Sample 5 with 5% by weight ¼" chopped glass fibers | 8 | 2 |
| Sample 7 | A commercially available polyurethane based sealant (TREMproof ® 250GC-SL, available from Tremco, Inc., Beachwood, Ohio) | 8 | 4 |
| Sample 8 | The commercially available polyurethane based sealant of Sample 7 with 5% by weight ¼" chopped glass fibers | 8 | 8 |

*Modified with the styrene butadiene rubber latex of Sample F

TABLE 2

| Qualitative Adhesion Scale | |
|---|---|
| Adhesion Value | Description |
| 0 | Clean adhesive failure - no force required to remove shotcrete from matrix material, with no shotcrete residue left behind |
| 2 | Clean adhesive failure - minimal force required to remove shotcrete from matrix material, with no shotcrete residue left behind |
| 4 | Clean adhesive failure - some force required to remove shotcrete from matrix material |
| 6 | Shallow cohesive failure - some force required to remove shotcrete from matrix material; shotcrete layer fractures, leaving a thin layer at the interface |
| 8 | Cohesive failure - force required to remove shotcrete from matrix material; shotcrete layer fractures, leaving a significant layer adhered to the matrix material |
| 10 | Cohesive failure - significant force required to remove shotcrete from matrix material; shotcrete layer fractures, leaving a significant layer adhered to the matrix material |

As seen in Table 1, the adhesion values observed for Samples 2, 3, and 4 indicate that the matrix materials for those samples preferentially adhere to the shotcrete material rather than to the wood material. On the other hand, the adhesion values observed for Sample 5 indicate that the matrix material used for that sample preferentially adheres to the wood material rather than the shotcrete material. Furthermore, with the exception of Sample 6, adhesion to the shotcrete was successfully maintained or increased by the addition of the filler material (i.e., 5% by weight ¼" chopped glass fibers) to the matrix material.

Example 2

In this example, quantitative tests were conducted to evaluate the adhesive values of several matrix materials to a wood material. The quantitative testing was conducted as follows. Approximately 60 mils (about 1.5 mm) of matrix material (with or without a filler) was applied to a 3 inch by 6 inch piece of oriented strand board (OSB). A 1 inch wide strip of steel mesh was applied to the wet matrix material before applying another gradient of matrix material and allowing to cure for 2 weeks at 77° F. and 50% relative humidity. After cure, the resulting assembly was subjected to a peel test in accordance with ASTM C794. The results of the peel test (in pounds per linear inch (pli)) are shown in Table 3.

TABLE 3

| Quantitative Testing Results | | |
|---|---|---|
| Sample No. | Matrix Material | Adhesion to Wood |
| Sample A | The commercially available polymer modified asphalt emulsion sealant of Sample 1 | 5.4 pli (cohesive) |
| Sample B | The commercially available polymer modified asphalt emulsion sealant of Sample 1 with 5% by weight 1" chopped glass fibers | 13.8 pli (cohesive) |
| Sample C | The commercially available polymer modified asphalt emulsion sealant of Sample 1 with 5% by weight ¼" chopped glass fibers | 4.8 pli (cohesive) |
| Sample D | The commercially available polyurethane methacrylate based sealant of Sample 3 with 5% by weight ¼" chopped glass fibers | 7.9 pli (cohesive) |
| Sample E | The commercially available polyurea based sealant of Sample 5 with 5% by weight ¼" chopped glass fibers | 31.3 pli (cohesive) |
| Sample F | A styrene butadiene rubber (SBR) latex with 5% by weight ¼" chopped glass fibers | 0.6 pli (cohesive) |
| Sample G | The commercially available polyurethane based sealant of Sample 7 | 12.6 pli (cohesive) |
| Sample H | The commercially available polyurethane based sealant of Sample 7 with 5% by weight ¼" chopped glass fibers | 6.3 pli (cohesive) |

As seen in Table 3, the addition of filler material (i.e., 5% by weight ¼" chopped glass fibers) to the matrix material of Sample A reduced the measured adhesion to wood from 5.4 pli (Sample A) to 4.8 pli (Sample C). Sample F had the lowest adhesion value to the wood of all the matrix materials tested. Furthermore, the addition of filler material (i.e., 5% by weight ¼" chopped glass fibers) to the matrix material of Sample G reduced the measured adhesion to wood from 12.6 pli (Sample G) to 6.3 pli (Sample H).

Sample A was also tested to evaluate the adhesive value of the matrix material to a simulated shotcrete material. The sample was prepared as described above and further included applying a wet mix of Eucoshot 105 50 shotcrete (available from Euclid Chemical Co., Cleveland, Ohio) to the cured matrix material and then compressing the shotcrete with 2 psi of force to simulate real world shotcrete impingement forces. After the shotcrete material cured, a peel test was performed on the sample. The adhesive value of the matrix material to the simulated shotcrete material for Sample A was 8.9 pli (cohesive), which indicates that the matrix material of Sample A preferentially adheres to the shotcrete material rather than to the wood material (5.4 pli (cohesive)).

All percentages, parts, and ratios as used herein, are by weight of the total composition, unless otherwise specified. All such weights as they pertain to listed ingredients are based on the active level and, therefore, do not include solvents or by-products that may be included in commercially available materials, unless otherwise specified.

All references to singular characteristics or limitations of the present disclosure shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more (e.g., 1 to 6.1), and ending with a maximum value of 10 or less (e.g., 2.3 to 9.4, 3 to 8, 4 to 7), and finally to each number 1, 2, 3, 4, 5, 6, 7, 8, 9, and 10 contained within the range.

The system and method of the present disclosure can comprise, consist of, or consist essentially of the essential elements and limitations of the disclosure as described herein, as well as any additional or optional ingredients, components, or limitations described herein or otherwise useful in blindside waterproofing applications.

The compositions and materials associated with the system and method of the present disclosure may also be substantially free of any optional or selected essential ingredient or feature described herein, provided that the remaining composition still contains all of the required ingredients or features as described herein. In this context, and unless otherwise specified, the term "substantially free" means that the selected composition contains less than a functional amount of the optional ingredient, typically less than 0.1% by weight, and also including zero percent by weight of such optional or selected essential ingredient.

To the extent that the terms "include," "includes," or "including" are used in the specification or the claims, they are intended to be inclusive in a manner similar to the term "comprising" as that term is interpreted when employed as a transitional word in a claim. Furthermore, to the extent that the term "or" is employed (e.g., A or B), it is intended to mean "A or B or both A and B." When the Applicant intends to indicate "only A or B but not both," then the term "only A or B but not both" will be employed. Thus, use of the term "or" herein is the inclusive, and not the exclusive use. Furthermore, the phrase "at least one of A, B, and C" should be interpreted as "only A or only B or only C or any combinations thereof" In the present disclosure, the words "a" or "an" are to be taken to include both the singular and the plural. Conversely, any reference to plural items shall, where appropriate, include the singular.

In some embodiments, it may be possible to utilize the various inventive concepts in combination with one another. Additionally, any particular element recited as relating to a particularly disclosed embodiment should be interpreted as available for use with all disclosed embodiments, unless incorporation of the particular element would be contradictory to the express terms of the embodiment. Additional advantages and modifications will be readily apparent to those skilled in the art. Therefore, the disclosure, in its broader aspects, is not limited to the specific details presented therein, the representative apparatus, or the illustrative examples shown and described. Accordingly, departures may be made from such details without departing from the spirit or scope of the general inventive concepts.

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the methods and systems disclosed. It is sought, therefore, to cover all such changes and modifications as fall within the spirit and scope of the general inventive concepts, as described and/or claimed herein, and any equivalents thereof.

What is claimed is:

1. A blindside waterproofed building foundation system comprising:

i) a lagging wall;

ii) a monolithic waterproof layer adjacent to and in direct contact with the lagging wall; and iii) a foundation layer adjacent to the monolithic waterproof layer, wherein an adhesive value between the monolithic waterproof layer and the foundation layer is greater than an adhesive value between the monolithic waterproof layer and the lagging wall.

2. The system of claim 1, wherein the lagging wall comprises a plurality of piles and a plurality of lagging planks placed between and spanning adjacent piles.

3. The system of claim 1, wherein the monolithic waterproof layer comprises:

i) a matrix material selected from a polyolefin, polyvinyl chloride, polyvinylidene chloride, a polyester, a polystyrene, a polyamide, ethylene vinyl acetate, a polyurethane, a polyurea, a polyepoxide, a fluoropolymer, a polyacrylonitrile, a polyacrylic, a rubber material, silicone, a silicone hybrid, and combinations thereof; and ii) a filler material selected from glass fibers, polymer fibers, carbon fibers, ceramic fibers, metal fibers, natural fibers, glass flakes, corn-cob shell, walnut shell, sand, silica, calcium carbonate particles, limestone particles, limestone fines, ground reprocessed concrete, ground rubber, polymeric particles, Portland cement, pozzolanic materials, expanded glass spheres, and combinations thereof.

4. The system of claim 1, wherein the foundation layer comprises shotcrete.

5. The system of claim 1, wherein the monolithic waterproof layer comprises a first gradient of material comprising a first matrix material and a first filler material, and a second gradient of material comprising a second matrix material and optionally a second filler material.

6. The system of claim 5, wherein the first matrix material is the same as the second matrix material.

7. The system of claim 6, wherein the second gradient of material does not contain any second filler material.

8. The system of claim 6, wherein the second gradient of material comprises a second filler material.

9. The system of claim 5, wherein the first matrix material is different from the second matrix material.

10. The system of claim 9, wherein the second gradient of material does not contain any second filler material.

11. The system of claim 9, wherein the second gradient of material comprises a second filler material.

12. A method of forming a blindside waterproofed building foundation, the method comprising:

forming a lagging wall;

applying a monolithic waterproof layer directly to the lagging wall; and applying a foundation layer to the monolithic waterproof layer, wherein an adhesive value between the monolithic waterproof layer and the foundation layer is greater than an adhesive value between the monolithic waterproof layer and the lagging wall.

13. The method of claim 12, wherein forming the lagging wall comprises installing a plurality of piles into an excavation site and placing a plurality of lagging planks between adjacent piles.

14. The method of claim 12, wherein the monolithic waterproof layer is spray-applied onto the lagging wall.

15. The method of claim 12, wherein the foundation layer is spray-applied onto the monolithic waterproof layer.

16. The method of claim 12, wherein the monolithic waterproof layer comprises:

i) a matrix material selected from a polyolefin, polyvinyl chloride, polyvinylidene chloride, a polyester, a polystyrene, a polyamide, ethylene vinyl acetate, a polyurethane, a polyurea, a polyepoxide, a fluoropolymer, a polyacrylonitrile, a polyacrylic, a rubber material, silicone, a silicone hybrid, and combinations thereof; and ii) a filler material selected from glass fibers, polymer fibers, carbon fibers, ceramic fibers, metal fibers, natural fibers, glass flakes, corn-cob shell, walnut shell, sand, silica, calcium carbonate particles, limestone particles, limestone fines, ground reprocessed concrete, ground rubber, polymeric particles, Portland cement, pozzolanic materials, expanded glass spheres, and combinations thereof.

17. The method of claim 12, wherein the foundation layer comprises shotcrete.

18. The method of claim 12, wherein the step of applying the monolithic waterproof layer directly to the lagging wall comprises spray-applying a first gradient of material comprising a first matrix material and a first filler material onto the lagging wall, and spray-applying a second gradient of material comprising a second matrix material and optionally a second filler material onto the first gradient of material.

19. The method of claim 12, wherein the step of applying the monolithic waterproof layer directly to the lagging wall comprises applying a first gradient of material comprising a first matrix material and a first filler material onto the lagging wall using a first application technique, and applying a second gradient of material comprising a second matrix material and optionally a second filler material onto the first gradient of material using a second application technique that is different from the first application technique.

20. The method of claim 19, wherein the first application technique is spraying and the second application technique is at least one of rolling, brushing, and painting.

* * * * *